US008398258B1

(12) United States Patent
Gerrish et al.

(10) Patent No.: US 8,398,258 B1
(45) Date of Patent: Mar. 19, 2013

(54) CYLINDRICAL LIGHT FIXTURE

(76) Inventors: Todd Gerrish, Stratham, NH (US); Bradford Lowery, Wayland, MA (US)

( * ) Notice: Subject to any disclaimer, the term of this patent is extended or adjusted under 35 U.S.C. 154(b) by 111 days.

(21) Appl. No.: 13/094,777

(22) Filed: Apr. 26, 2011

Related U.S. Application Data

(60) Provisional application No. 61/327,869, filed on Apr. 26, 2010.

(51) Int. Cl.
*F21L 4/00* (2006.01)
*F21L 13/00* (2006.01)
*G08B 5/22* (2006.01)

(52) U.S. Cl. ..... 362/183; 362/253; 362/276; 362/802; 340/815.45

(58) Field of Classification Search ..... 362/86, 362/154, 183, 253, 276, 802; 340/815.45, 340/815.46
See application file for complete search history.

(56) References Cited

U.S. PATENT DOCUMENTS 2,176,667 A * 10/1939 Crowley ..... 455/344
3,869,641 A * 3/1975 Goldberg ..... 315/135
6,539,917 B2 * 4/2003 Shaw et al. ..... 123/339.1
7,938,562 B2 * 5/2011 Ivey et al. ..... 362/276
8,113,689 B2 * 2/2012 Mayo et al. ..... 362/253
8,251,544 B2 * 8/2012 Ivey et al. ..... 362/276
2010/0027249 A1 * 2/2010 Connor et al. ..... 362/183

OTHER PUBLICATIONS

Spiral LED light tube, Acolyte Industries, 2009.

* cited by examiner

*Primary Examiner* — John A Ward
(74) *Attorney, Agent, or Firm* — Altman & Martin; Steven K Martin

(57) ABSTRACT

A light fixture built around a cylindrical, light-weight core. Mounted within the core are a battery, an LED driver, a DMX512 receiver, and an antenna. An LED ribbon is wound spirally around the core and is electrically connected to the LED driver. Circular bottom and top caps are mounted to the bottom and top of the core. A seamless, cylindrical lens coaxially aligned with the core is positioned between the caps. The top cap has several controls including a power switch, a battery charger port, and an LCD display that indicates various settings and conditions. Optionally, the top cap includes a mechanism for hanging the fixture.

13 Claims, 5 Drawing Sheets

CYLINDRICAL LIGHT FIXTURE

CROSS-REFERENCES TO RELATED APPLICATIONS

The present application claims the benefit of and priority to U.S. Provisional Patent Application No. 61/327,869, filed on Apr. 26, 2010 for title LED Cylinder Luminaire in the names of Todd Gerrish and Bradford Lowery, and is hereby incorporated by reference in its entirety.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to lighting, more particularly, to LED light fixtures.

2. Description of the Related Art

Cylindrical light fixtures are used in the entertainment industry as visual enhancements, such as for mood lighting or for internal illumination.

Current wireless DMX512, battery powered LED fixtures are predominantly large in size, and are not designed to be looked at but are designed to illuminate other objects. Also, many of them use a proprietary control method, like a simple radio frequency or infra-red remote. In addition, most wireless LED fixtures are heavier than ten pounds, making them very difficult to suspend safely and cleanly from a tent beam or hanging grid.

No fixture currently being sold has a seamless, 360-degree lens. The Cyclone 360 from ColorMaker has a full 360 degrees of light output, but does not have a seamless lens. It also has unsightly metal and hardware which hinders its use as a light fixtures in the entertainment industry.

A number of light fixtures have only a single color and are without a way to adjust the brightness.

There are currently no light-emitting diode (LED) light fixtures for the entertainment industry that have a combination of 360-degree seamless light output, low weight, small size, battery operation, multi-color output with adjustable brightness, wireless DMX512 control, and clean appearance.

BRIEF SUMMARY OF THE INVENTION

The present invention is a light fixture that (1) has a clean appearance, (2) lights itself up, (3) has a 360-degree, seamless, frosted lens with no obstructions, (4) can be made small and light weight, (5) responds to wireless control using the DMX512 protocol, (6) requires minimal set-up time, and (7) is completely self-contained.

The fixture is built around a cylindrical, light-weight core. Mounted within the core are a rechargeable battery, an LED driver printed circuit board (PCB), a DMX512receiver PCB, and an antenna. These components can be mounted in the core to be either user serviceable or not.

An LED ribbon is wound spirally around the core and is electrically connected to the LED driver board by leads through holes in the core. Alternatively, there can be multiple LED ribbons for more variety in the lighting of the fixture.

Circular bottom and top caps are mounted to the bottom and top of the core, either permanently or removably. A seamless, cylindrical lens coaxially aligned with the core is positioned between the caps. The caps secure the lens in place in whatever manner is practical. The lens is typically frosted, but can be transparent or translucent. The lens typically has a circular cross-section but can be other the circular.

The top cap has several controls including a power switch, a battery charger port, and an LCD display that indicates various settings and conditions. Optionally, the top cap includes a mechanism for hanging the fixture 10.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present invention is a light fixture with a combination of characteristics that provide a large improvement over fixtures of the prior art.

The fixture has a clean appearance and is very pleasing to the eye from all angles. It is specifically designed to light itself up and to light other objects internally. It has a 360-degree, seamless, frosted lens that completely diffuses the light emitted by the LEDs. The fixture has no external or internal bracing or framework that obstructs the light in any way.

The fixture can be made smaller and lighter than fixtures of the prior art. The present design is only ten inches long with a five-inch diameter, making it small enough to fit into Chinese lanterns, spandex shapes, plastic furniture, and under tables. The fixture weighs under five pounds, as compared to the ten pounds or more of currently available fixtures, so it can be easily and safely hung with monofilament line.

The fixture responds to wireless control using the DMX512 protocol, the standard protocol for controlling lighting units in the industry. It provides the user with full control of color and intensity, allowing users to program effects and timing on DMX512 consoles.

The fixture requires no assembling and minimal set-up time. It is ready to be used right out of the road case. There are no cables to attach and no separate parts like batteries or wireless packs. It is completely self-contained and can be placed or hung with ease.

Figure 1:
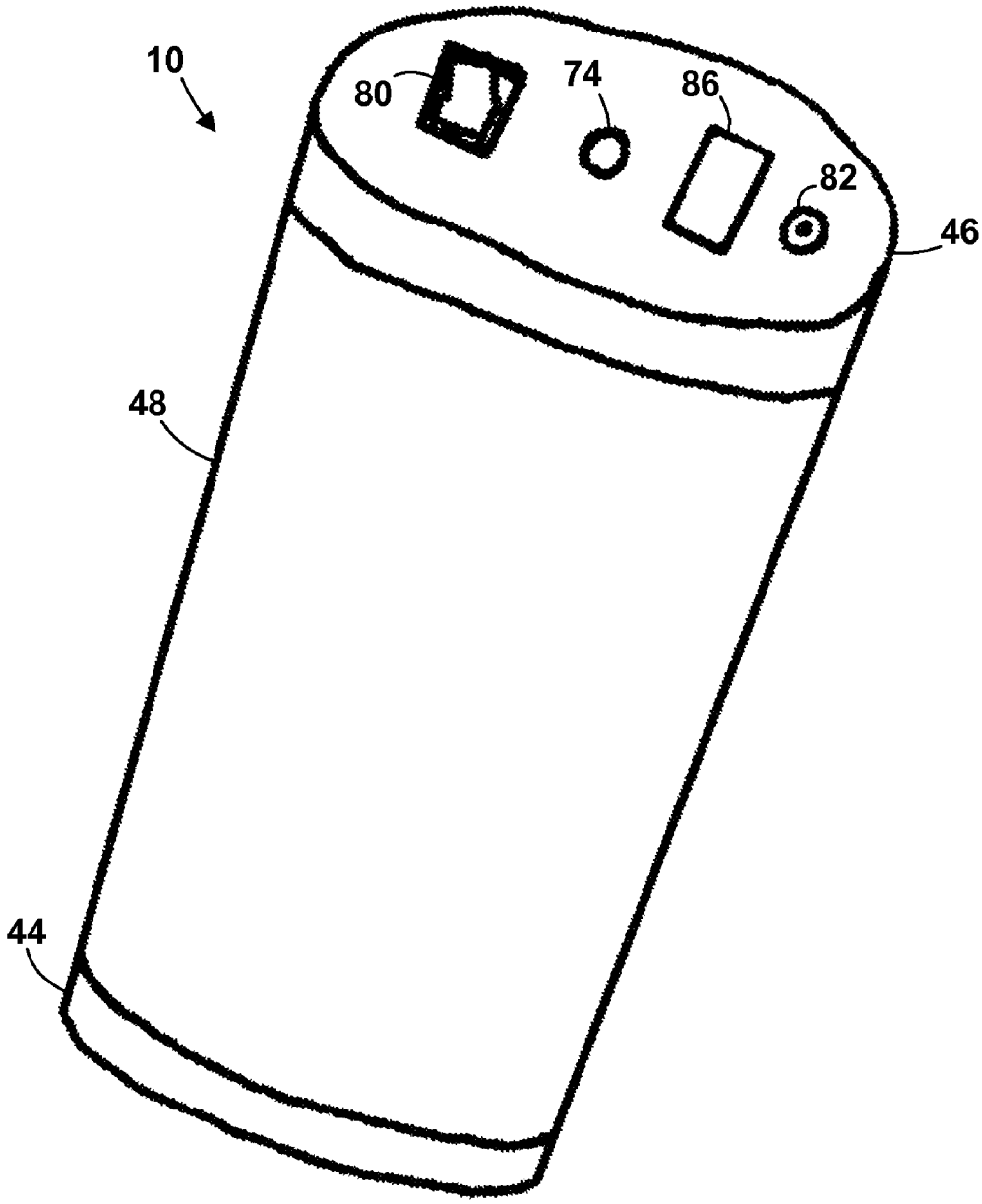
FIG. 1 is a perspective view of the cylindrical light fixture of the present invention.
Figure 2:
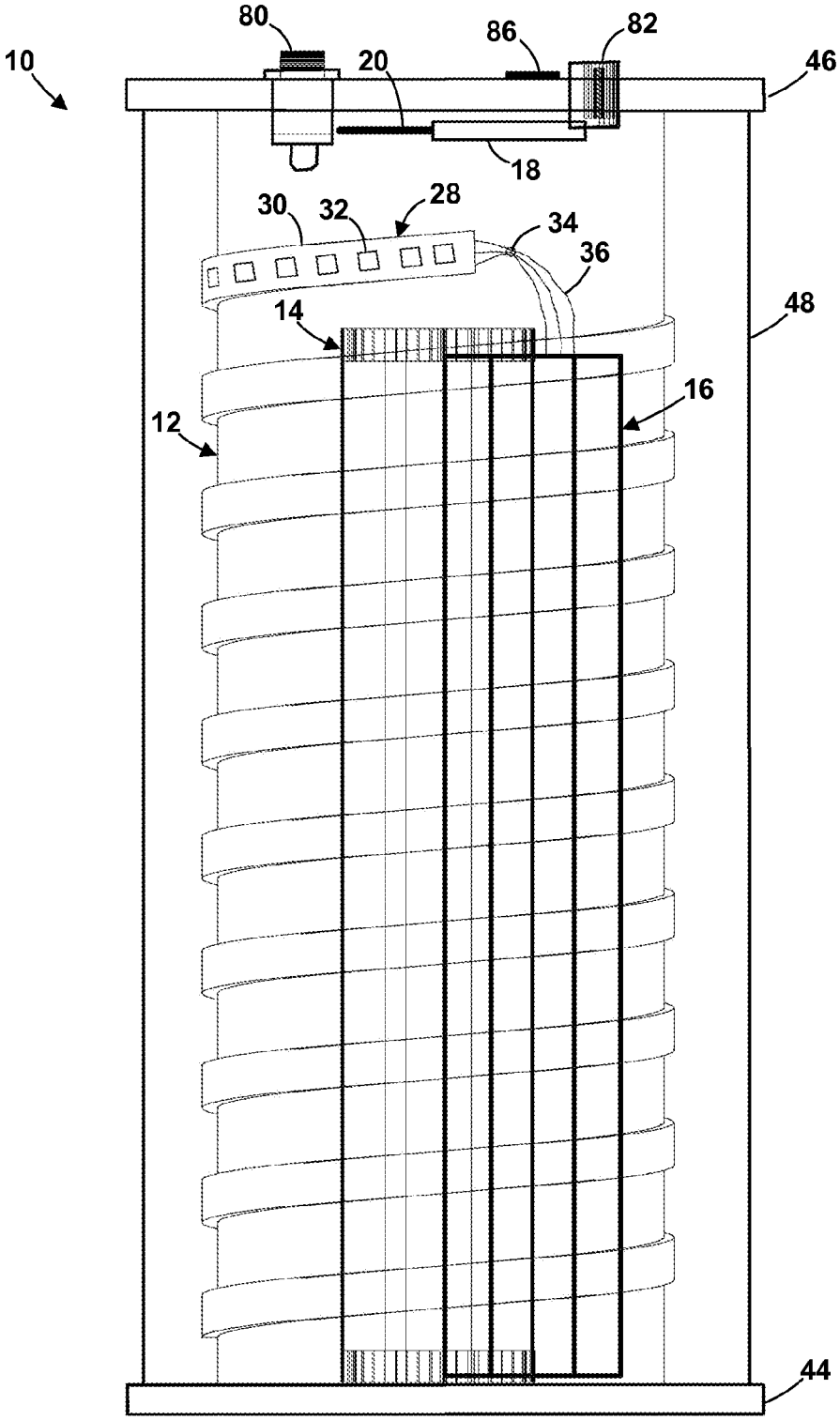
FIG. 2 is a side view in partial phantom of the light fixture of the present invention.
Figure 3:
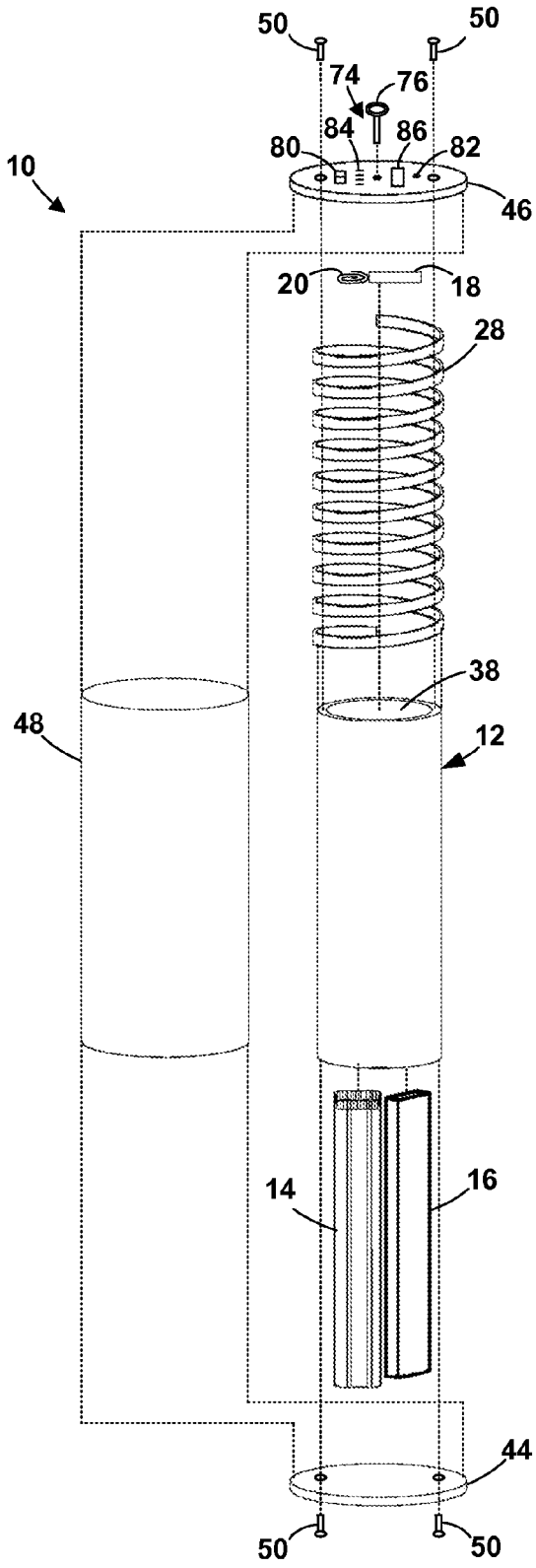
FIG. 3 is an exploded view of the light fixture of FIG. 1.
Figure 4:
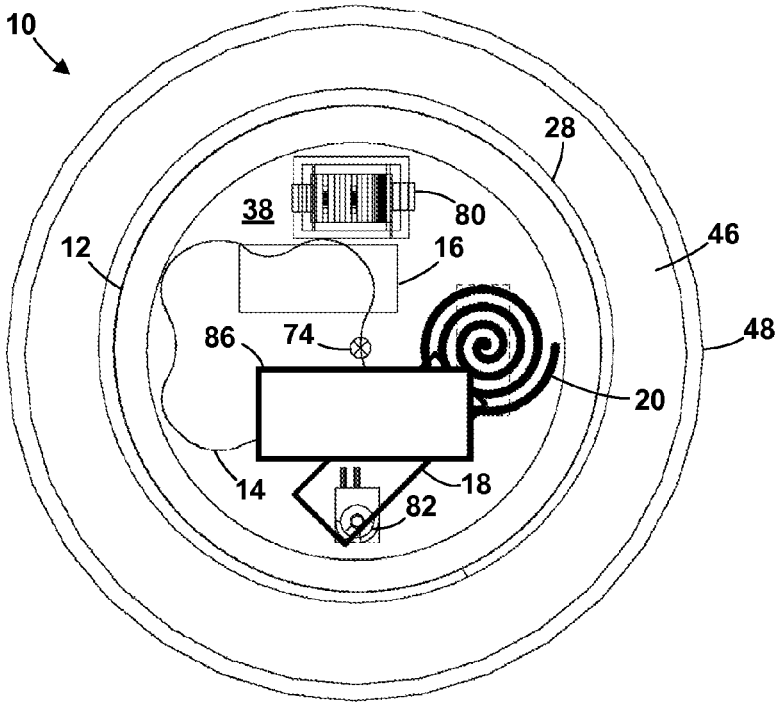
FIG. 4 is a top view in partial cross section of the fixture of FIG. 1.

The fixture 10 of the present invention has a number of components. As shown in FIGS. 2-4, the fixture 10 is built around a cylindrical core 12. The core 12 is composed of a light-weight, generally rigid material. A preferred material is polyvinyl chloride (PVC). The present invention contemplates that other materials can be used as long as the core 12 is reasonably transparent to the radio frequencies used by the DMX512 control protocol.

Mounted within the core 12 are the battery pack 14, the LED driver printed circuit board (PCB) 16, the DMX512 receiver PCB 18, and the antenna 20. In one configuration, these components are not intended to be user-serviceable and are secured together and to the core 12 with adhesives. Alternatively, the components are packed in foam or other shaped material and inserted into one end of the core 12 so that they can be removed from the core 12 for service. Alternatively, the components can be fitted into the core 12 in any way that allows the components to be easily removed and/or to be user serviceable.

The antenna 20 is located within the core 12 such that the battery 14 does not block signal reception. Preferably, the antenna 20 is located above or below the battery 14. Optionally, the antenna 20 in integrated with the DMX512 receiver PCB 18.

The preferred battery 14 is a rechargeable lithium-ion battery (LIB), but any other type of battery that supplies the necessary power can be used, including other rechargeable batteries and single-use batteries. Alternatively, the fixture 10 can powered externally by a battery and/or by a plug to AC wall power. In such case, the internal battery 14 is optional.

As shown in FIG. 2, an LED ribbon 28 is wound spirally around the core 12. The LED ribbon 12 is a flexible PCB 30 with LED chips 32 of various colors mounted to it. The LED ribbon 28 used in the present embodiment has RGB (red, green, blue) LED chips 32 mounted on it. The present invention contemplates that LEDs of single colors or other combinations of colors can be used. An adhesive is used to attach the LED ribbon 28 to the core 12. Optionally, the adhesive is an adhesive strip on the back of the LED ribbon 28. Optionally, the adhesive allows removal of the LED ribbon 28 for repair or replacement.

The LED ribbon 28 is electrically connected to the LED driver board 16 by leads 34 through holes 36 in the side of the core 12 to the core interior 38 where the LED driver PCB 16 is located. The number of leads 34 will depend on the number of different colors of LEDs there are on the LED ribbon 28. There is a common lead and one lead for each color. Thus, for an RGB LED ribbon, there are four leads 34.

Figure 5:
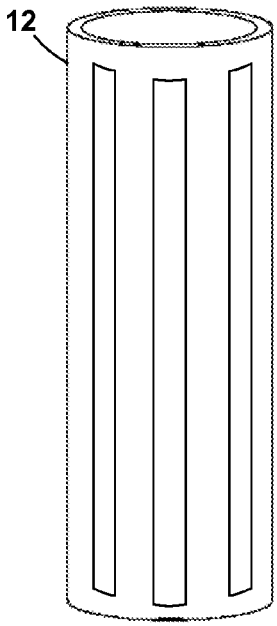
FIG. 5 is a side view of a configuration of LED ribbons mounted longitudinally on the core.
Figure 6:
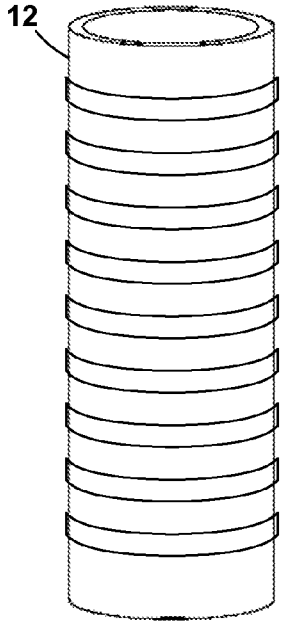
FIG. 6 is a side view of a configuration of LED ribbons mounted horizontally on the core.

Alternatively, rather than a single LED ribbon, there can be multiple LED ribbons for more variety in the lighting of the fixture 10. In one example, there can be two LED ribbons wound spirally around the core 12 in a double helix structure. In another example, there can be two LED ribbons, one wound spirally on the top half of the core 12 and the other attached wound spirally on the bottom half of the core 12. In another example, there can be multiple LED ribbons mounted longitudinally on the core 12, as in FIG. 5. In another example, there can be multiple LED ribbons wound horizontally around the core 12, as in FIG. 6.

Optionally, the LEDs are mounted to hard PCBs that are attached to the core 12 or otherwise mounted within the fixture 10.

A circular bottom cap 44 is mounted to the bottom of the core 12 and a circular top cap 46 is mounted to the top of the core 12. Both caps 44, 46 can be permanently attached to the core, both caps 44, 46 can be removably attached to the core 12, or one cap 44 can be permanently attached and other cap 46 can be removably attached. A permanent attachment can be by adhesive and a removable attachment can be by screws 50.

Figure 7:
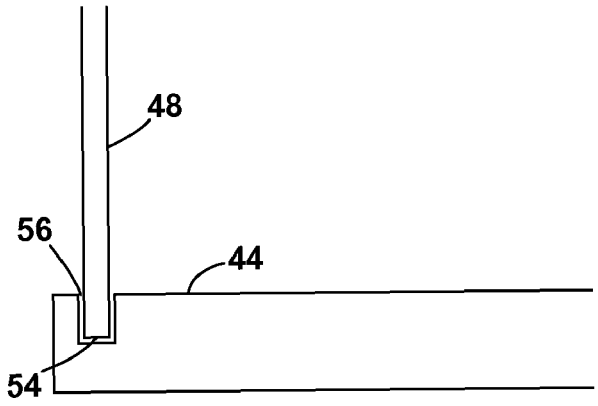
FIG. 7 is a cross-sectional view of another method of securing the lens with the cap.

A seamless, cylindrical lens 48 is located between the bottom cap 44 and top cap 46 and is coaxially aligned with the core 12. The caps 44, 46 secure the lens 48 in position. The present invention contemplates that the lens 48 can be secured to the caps 44, 46 in any way that is practical. In one example, the lens 48 is secured to the bottom cap 44 and top cap 46 using an adhesive. In another, shown in FIG. 7, the lens 48 is secured to the caps 44, 46 by annular grooves 56 in the caps 44, 46 that the lens edges 54 fit into. Rotation of the lens 48 can be prevented by a finger from at least one of the caps 44, 46 that fits into a notch in the lens edge 54. Alternatively, the grooves 56 can be less than fully annular.

Figure 8:
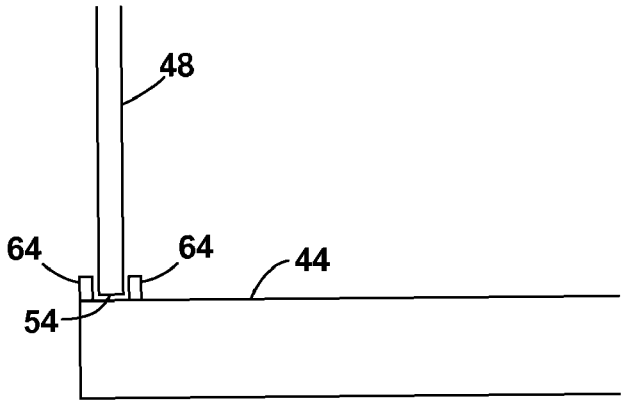
FIG. 8 is a cross-sectional view of another method of securing the lens with the cap.

In another method of securing the lens 48, the lens edges 54 fit outside of fingers 56 extending from the caps 44, 46, as in FIG. 8. Alternatively, the fingers 56 are longer and curved to follow the inside curve of the lens 48.

Figure 9:
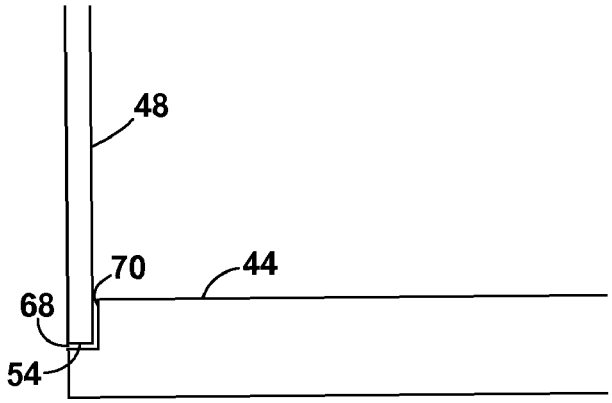
FIG. 9 is a cross-sectional view of another method of securing the lens with the cap.

In another method of securing the lens 48, each cap 44, 46 has an annular notch 68, as in FIG. 9. The smaller diameter portion 70 of the caps 44, 46 fit inside the lens 48.

Because the lens 38 is secured solely by the caps 44, 46, there are no visual obstructions between the LED ribbon 28 and the lens 48.

The lens 48 is typically frosted, but can be transparent or translucent. It is typically a clear lens, but can be colored.

In the illustrated fixture of the present specification, the lens 48 has a circular cross-section. However, the present invention contemplates that the lens 48 can be a cross-sectional shape other the circular, such as oval, square, rectangular, hexagonal, and octagonal.

Optionally, the top cap 44 includes a mechanism 74 for hanging the fixture 10. Such mechanism can be one or more screw eyes 76, hooks, or other similar devices. Optionally, the hanging mechanism 74 is removable.

The top cap 46 has several controls including a power switch 80, a battery charger port 82, and an LCD display 86.

Optionally, the top cap 46 includes a 5-pin DMX jack so that the fixture 10 can be connected to other DMX512 devices. The fixture 10 can act as a wireless DMX512 receiver master device that can be used to control other DMX512 slave devices that do not have wireless capability.

The LCD display 86 indicates various settings and conditions including the radio frequency, radio signal presence, master/slave function, etc.

The antenna 20 receives radio signals sent from any compatible DMX512 transmitter, from hand-held remote controls to large consoles, and forwards the signals to the DMX512 receiver PCB 18. The DMX512 receiver PCB 18 converts the DMX512 radio signals to DMX512 wired signals and sends them to the LED driver PCB 16. The LED driver PCB 16 interprets the DMX512 signals as instructions to control the LED ribbon 28. The LED ribbon 28 can be controlled via the DMX512 protocol for color and intensity and with timing elements to create dynamic color effects, static colors, and strobing.

The seamless, 360-degree lens 48 is primarily what gives the fixture 10 of the present invention its clean and pleasing look. Putting all of the major electrical components within the core and securing the lens 48 solely at the caps 44, 46 allow for a completely unobstructed light output of the LED ribbon 28 to the lens 48.

Thus it has been shown and described a cylindrical light fixture which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A light fixture comprising:

(a) a generally rigid, hollow, cylindrical core having a wall, an interior, an outer surface, a top end, and a bottom end;

(b) a DMX512 radio receiver mounted within said core interior;

(c) an antenna mounted within said core interior and operatively connected to said DMX512 radio receiver;

(d) an LED driver mounted within said core interior and operationally connected to said DMX512 radio receiver;

(e) a battery mounted within said core interior operationally connected to power said DMX512 radio receiver and said LED driver;

(f) at least one LED ribbon mounted to said core outer surface and operationally connected to said LED driver;

(g) a top end cap mounted to said core top end;

(h) a bottom end cap mounted to said core bottom end; and (i) a 360-degree cylindrical lens mounted between said top end cap and said bottom end cap.

2. The light fixture of claim 1 wherein said at least one LED ribbon is wrapped spirally on said core outer surface.

3. The light fixture of claim 1 wherein said at least one LED ribbon has LEDs in a plurality of colors.

4. The light fixture of claim 1 wherein there are no visual obstructions between said at least one LED ribbon and said lens.

5. The light fixture of claim 1 wherein said lens is frosted.

6. The light fixture of claim 1 wherein said lens has a round cross-section.

7. The light fixture of claim 1 wherein said battery is rechargeable.

8. The light fixture of claim 1 wherein said top end cap includes a mechanism for hanging said fixture.

9. The light fixture of claim 1 wherein said at least one LED ribbon is operationally connected to said LED driver by leads extending through holes in said core wall.

10. A light fixture comprising:

(a) a generally rigid, hollow, cylindrical core having a wall, an interior, an outer surface, a top end, and a bottom end;

(b) a DMX512 radio receiver mounted within said core interior;

(c) an antenna mounted within said core interior and operatively connected to said DMX512 radio receiver;

(d) an LED driver mounted within said core interior and operationally connected to said DMX512 radio receiver;

(e) a rechargeable battery mounted within said core interior operationally connected to power said DMX512 radio receiver and said LED driver;

(f) at least one LED ribbon with LEDs in a plurality of colors wrapped spirally and mounted to said core outer surface and operationally connected to said LED driver;

(g) a top end cap mounted to said core top end, said top end cap including a mechanism for hanging said fixture;

(h) a bottom end cap mounted to said core bottom end; and (i) a 360-degree cylindrical lens mounted between said top end cap and said bottom end cap.

11. The light fixture of claim 10 wherein there are no visual obstructions between said at least one LED ribbon and said lens.

12. The light fixture of claim 10 wherein said lens has a round cross-section.

13. The light fixture of claim 1 wherein said at least one LED ribbon is operationally connected to said LED driver by leads extending through holes in said core wall.

* * * * *